US005839035A

United States Patent [19]

Rathbun

[11] Patent Number: 5,839,035

[45] Date of Patent: Nov. 17, 1998

[54] PHOTOMODE CONTRAST CONTROL SYSTEM FOR AN ELECTROSTATOGRAPHIC PRINTING MACHINE

[75] Inventor: Darrel R. Rathbun, Ontario, N.Y.

[73] Assignee: Xerox Corporation, Stamford, Conn.

[21] Appl. No.: 867,549

[22] Filed: Jun. 2, 1997

[51] Int. Cl.[6] ..... G03G 15/04

[52] U.S. Cl. ..... 399/181; 399/51; 355/69; 355/74

[58] Field of Search ..... 399/51, 181–182, 399/180; 355/69, 70, 67, 74; 358/298

[56] References Cited

U.S. PATENT DOCUMENTS

| | | | |
|---|---|---|---|
| 3,535,036 | 10/1970 | Starkweather | 399/181 X |
| 3,540,806 | 11/1970 | Starkweather | 399/181 X |
| 4,014,030 | 3/1977 | Stark et al. | 346/160 |
| 4,066,353 | 1/1978 | Bobbe | 399/180 |
| 4,068,940 | 1/1978 | Bobbe | 399/180 |
| 4,179,209 | 12/1979 | Goren . | |
| 4,378,156 | 3/1983 | Yajima et al. | 355/77 |
| 4,385,823 | 5/1983 | Kasper et al. | 399/181 |
| 4,451,137 | 5/1984 | Farley | 399/138 |
| 4,537,490 | 8/1985 | Stoudt | 399/184 |
| 4,740,818 | 4/1988 | Tsilibes et al. . | |
| 4,783,680 | 11/1988 | Maloney | 347/131 |
| 4,912,505 | 3/1990 | Larson . | |

FOREIGN PATENT DOCUMENTS

| | | |
|---|---|---|
| 8-095319 | 4/1996 | Japan . |
| 8-274985 | 10/1996 | Japan . |
| 9-136449 | 5/1997 | Japan . |
| 9-211945 | 8/1997 | Japan . |

*Primary Examiner*—Matthew S. Smith

[57] ABSTRACT

An electrophotographic copying machine adapted to operate in either a functional or a pictorial mode, such that, in the pictorial mode, a light signal is transmitted through a line screen member to modulate an electrostatic latent image of an original document. The amount of light transmitted through the line screen is varied as a function of the amount of light used to generate the electrostatic latent image to control the contrast of the image generated thereby. As a result, pictorial image contrast is readily adjustable by regulating the light intensity of the light transmitted through the line screen member and onto the photoconductive surface for high quality pictorial copies in an electrostatographic copying machine.

18 Claims, 3 Drawing Sheets

PHOTOMODE CONTRAST CONTROL SYSTEM FOR AN ELECTROSTATOGRAPHIC PRINTING MACHINE

Figure 1:
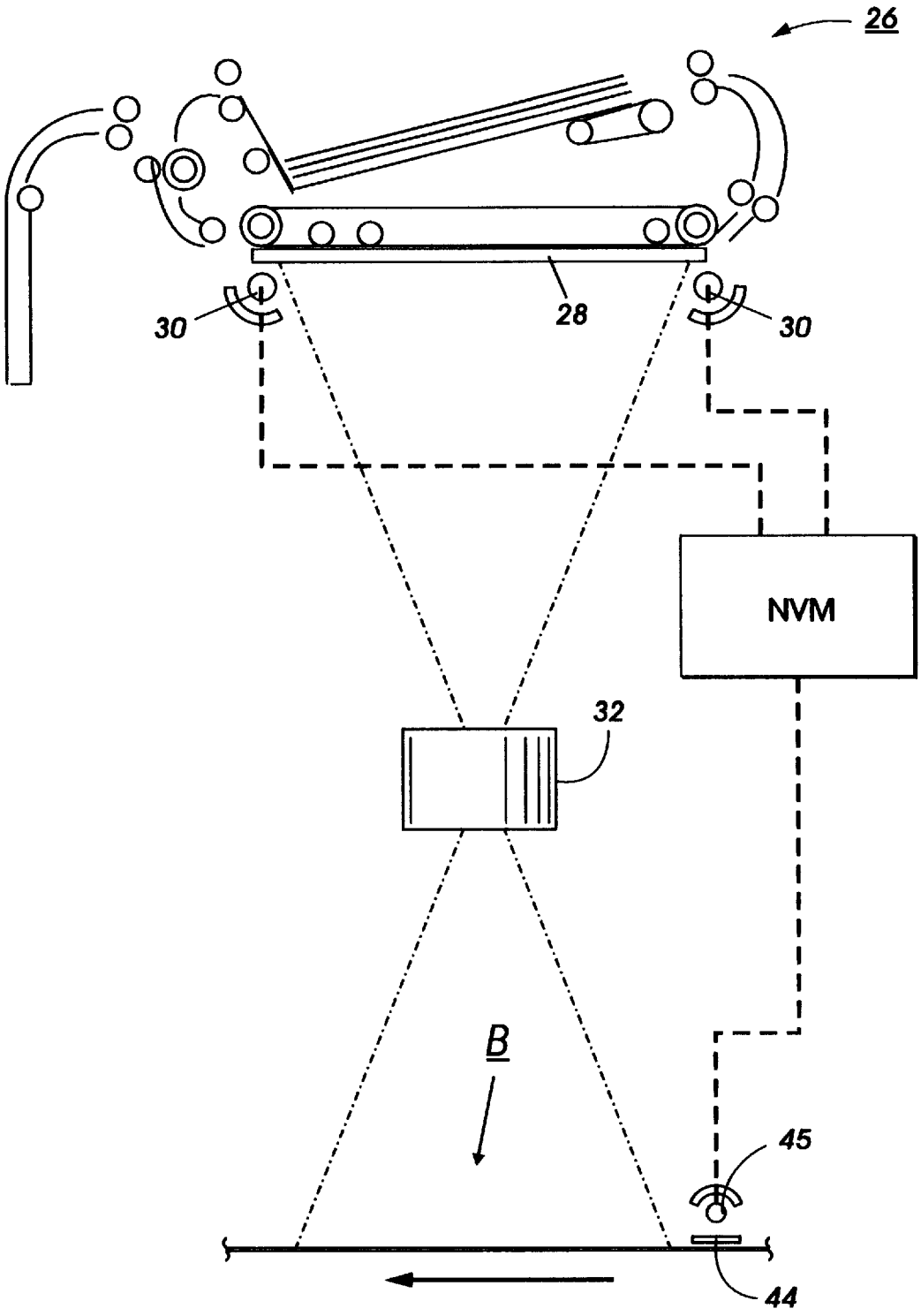

The present invention relates generally to an electrostatographic printing system, and more specifically concerns a variable contrast control system particularly for use in the pictorial or so-called photomode operation of an electrophotographic printing machine.

In a typical electrostatographic printing process, a photoconductive member is charged to a substantially uniform charge potential. The charged portion of the photoconductive member is subsequently exposed to a light image of an input document for selectively dissipating the charge thereon in imagewise configuration. This process records an electrostatic latent image on the photoconductive member corresponding to the image areas in the input document being reproduced. Thereafter, the electrostatic latent image is developed by bringing a developer material into contact therewith on the photoconductive member. Generally, the developer material is made from toner particles, either adhering triboelectrically to carrier granules or immersed in a carrier liquid. When placed in proximity to the latent image, the toner particles are attracted to the latent image, forming a visible developed image on the photoconductive member. This developed image is then transferred from the photoconductive member to a copy substrate such as a sheet of paper, where heat or some other treatment is applied to the toner particles for permanently affixing the powder image to the copy substrate. In a final process step, the photoreceptive member is cleaned to remove any residual developing material on the surface thereof in preparation for subsequent successive imaging cycles.

The electrostatographic printing process described above is well known and is commonly used for light lens copying from an original input document, as well as for digital printing applications which utilize electronically generated or stored input image information. Analogous processes also exist in other electrostatographic printing applications such as, for example, ionographic printing and reproduction, wherein electrical charges are deposited directly on a charge retentive surface in imagewise configuration in response to electronically generated or stored images.

Typically, in such electrostatographic printing systems, operator adjustable controls are provided to allow the operator to make fine adjustments to output image quality. To that end, distinct biasing voltages which are applied to various subsystems in the machine, such as the charging subsystem, the image exposure subsystem, and/or the developing subsystem, among others, may be increased or decreased for the purpose of enhancing copy quality. For example, since a particular printing apparatus may be expected to reproduce documents having various background and/or image density characteristics, a typical electrostatographic printing machine is provided with manual copy darkness and/or contrast modification controls for permitting the operator to vary output copy darkness and/or contrast through a range of copy control settings. In particular, copy contrast control and modification may be beneficially used to eliminate the development of background areas, in the case, for example, of an original input document printed on colored paper, or for permitting enhanced development, in the case, for example, of a light original input document where the charge on the photoreceptor may be too low to create a sufficient electrostatic latent image. Copy contrast is typically regulated by varying the bias voltage applied to the image exposure lamp, and thus the illumination intensity generated thereby.

Generally, state-of-the-art electrostatographic printing machines are adapted to produce both functional and/or pictorial a so-called "photomode" output copies. A functional copy is a copy of a document wherein image variations are present in a substantially binary manner, such as text, graphs, charts, and lines, etc. A pictorial or photomode copy is a copy of a document wherein continuous tone pictorial information including subtle variations of gray scale or color information are present, such as pictures, photographs, and other images. Photomode copying generally employs well known optical line screening techniques for enabling the creation of tonal gradations via half-tone lines or dots of varying size. Generally, optical line screening techniques involve the generation of a line screen pattern on the photoconductive member by exposing the charged photoconductor surface to a light source through a sequentially segmented light transmissive member, whereby the light transmissive member generates a cyclical pattern of charged and uncharged lines on the photoconductor surface. This line screen pattern enables half tone image processing, wherein a pictorial image is typically comprised of narrow lines or small dots in high light regions, with the lines increasing in width or the dots increasing in size throughout the intermediate shades until they merge together at the low light or shadow regions. In this manner, there will be complete whiteness at the highlight end and nearly solid black at the shadow end of the tone scale. The concept of optical line screening is well known, as exemplified by U.S. Pat. Nos. 2,598,732; 3,535,036; 3,121,010; 3,493,381; 3,776,633; and 3,809,555, among numerous other patents and publications. In addition, U.S. Pat. No. 4,007,981 discloses a dual mode electrostatographic printing machine for reproducing either functional or pictorial output copies, wherein the two modes of operation are operator selectable.

The present invention contemplates a system for controlling copy contrast by varying the light intensity exposed through the sequentially segmented light transmissive member. Moreover, the present invention is specifically directed to a method and apparatus for varying the light intensity exposed through the sequentially segmented light transmissive member as a function of the light intensity of the imaging exposure lamp for enabling contrast control in the photomode of an electrostatographic printing process while maintaining image darkness at a constant level. The following disclosures may be relevant to various aspects of the present invention:

U.S. Pat. No. 4,014,030

Patentee: Stark et al.

Issued: Dec. 18, 1979

U.S. Pat. No. 4,179,209

Patentee: Goren

Issued: Dec. 18, 1979

U.S. Pat. No. 4,740,818

Patentee: Tsilibes et al.

Issued: Apr. 26, 1988

U.S. Pat. No. 4,912,505

Patentee: Larson

Issued: Mar. 27, 1990

The relevant portions of the foregoing disclosures may be briefly summarized as follows:

U.S. Pat. No. 4,014,030 discloses half-tone imaging with a flying spot scanner system, wherein a highly collimated light beam is modulated with imaging information, reflected from a multi-faceted rotating polygon, and directed to a scanned medium through a light attenuating member. The light attenuating member is supported proximate to the imaging focal plane and orthogonal to the collimated, reflected light beam. The light attenuating member has an optical light transmission characteristic that varies in a continuous and cyclic pattern with a cycle period at least about ten times the maximum lateral extent of the collimated light beam, thereby serving to alter the system imaging from contrasting black and white patterns to half tones and gray colorations.

U.S. Pat. No. 4,179,209 discloses a novel multicolor line or cross line filter element and method for maintaining color balance In photoelectrophoretic imaging wherein the filter grid comprises a plurality of yellow, cyan and magenta color segments or their complementary colors of controlled varying widths for limiting color interaction in the resulting integrated image.

U.S. Pat. No. 4,740,818 discloses an electrophotographic reproduction apparatus and method for reproducing an original document sheet that includes a continuous tone pictorial information area and a line-type information area. Rather than reproducing the entire document sheet with screening of both types of information, means are provided for selectively screening only the pictorial information area on the reproduction. One preferred embodiment comprises a programmable illumination source that is programmed through inputs by the operator using a digitizing tablet to selectively image portions of a screen onto a charged photoconductive web prior to development of the electrostatic image formed on the web so that only the area on the web receiving the pictorial image is exposed to the screen. In another embodiment the programmable illumination source, such as LED's, modulates the portion of the image frame receiving an optical exposure of the pictorial information with the screen type exposure so that the pictorial information only is reproduced with a screen pattern. In still another embodiment a sensor automatically senses and determines the image portions to be selectively line screened.

U.S. Pat. No. 4,912,505 discloses a contrast control device for a copier exposure system utilizing an exposure adjustment to control contrast by reducing the contrast in a reproduction image of the original document. The degree of exposure adjustment is controlled by position adjustment of a sliding lever control.

As can be seen from the cited references, various techniques are known for reproducing continuous tone pictorial images and for enabling copy contrast control. Likewise, several techniques are known for carrying out line screening to enable half-tone imaging. The prior art, however, does not disclose an operator adjustable photo mode contrast control as provided by the present invention.

In accordance with the present invention, a system for controlling image contrast in an electrostatographic imaging system having a photoconductive member is described. The system includes a first light emitting source for projecting a light image of the original document onto the photoconductive member to create an electrostatic latent image thereon, and a second light emitting source for generating a line screen pattern on the photoconductive member such that the electrostatic latent image is positioned in superimposed registration with the line screen pattern on the photoconductive member to produce a modulated electrostatic latent image thereon. Apparatus are provided for varying the intensity of the light emitted from the first light emitting source and the second light emitting source. A control system for maintaining the total amount of the light emitted form the first and second light emitting sources substantially constant while varying the intensity of the light emitted from either the first or second first light emitting sources. The control system includes a system for generating a first variable voltage signal for varying the light emitted from the first light emitting source; and a second variable voltage signal for varying the light emitted from the second light emitting source, wherein the system for generating the first and second variable voltage signals includes an apparatus for modifying the second voltage signal as a function of the first voltage signal.

In accordance with another aspect of the present invention a method for producing halftone images in an electrostatographic copying machine including a photoconductive imaging member is disclosed, comprising the steps of: projecting a light image of an original document onto the photoconductive imaging member to create an electrostatic latent image thereon; generating a line screen pattern on the photoconductive imaging member such that the electrostatic latent image is positioned in superimposed registration with the line screen pattern on the photoconductive imaging member to produce a modulated electrostatic latent image thereon; varying an amount of light energy used in the light image projecting step; varying an amount of light energy used in the line screen pattern generating step; and maintaining substantially constant a total amount of light energy used in the light image projecting step and the line screen pattern generating step while varying the light energy used in either the light image projecting step and the line screen pattern generating step In accordance with yet another aspect of the present invention, an electrostatographic printing machine for reproducing an original document having continuous tone pictorial information, is disclosed, comprising: a photoconductive member; means for charging the photoconductive member to a substantially uniform potential; means, including an image exposure lamp, for projecting a light image of the original document onto the photoconductive member to create an electrostatic latent image thereon; means, including a sequentially segmented lamp, for generating a line screen pattern on the photoconductive member, wherein the electrostatic latent image is positioned in superimposed registration with the line screen pattern on the photoconductive member to produce a modulated electrostatic latent image thereon; means for controlling image contrast a reproduced image, comprising: first light emitting means for projecting a light image of the original document onto the photoconductive member to create an electrostatic latent image thereon; second light emitting means for generating a line screen pattern on the photoconductive member such that the electrostatic latent image is positioned in superimposed registration with the line screen pattern on the photoconductive member to produce a modulated electrostatic latent image thereon; means for varying intensity of the light emitted from the first light emitting source; means for varying intensity of the light emitted from the second light emitting source; and control means for maintaining a total amount of the light emitted form the first and second light emitting means substantially constant while varying light emitted from either the first or second first light emitting means.

Figure 2:
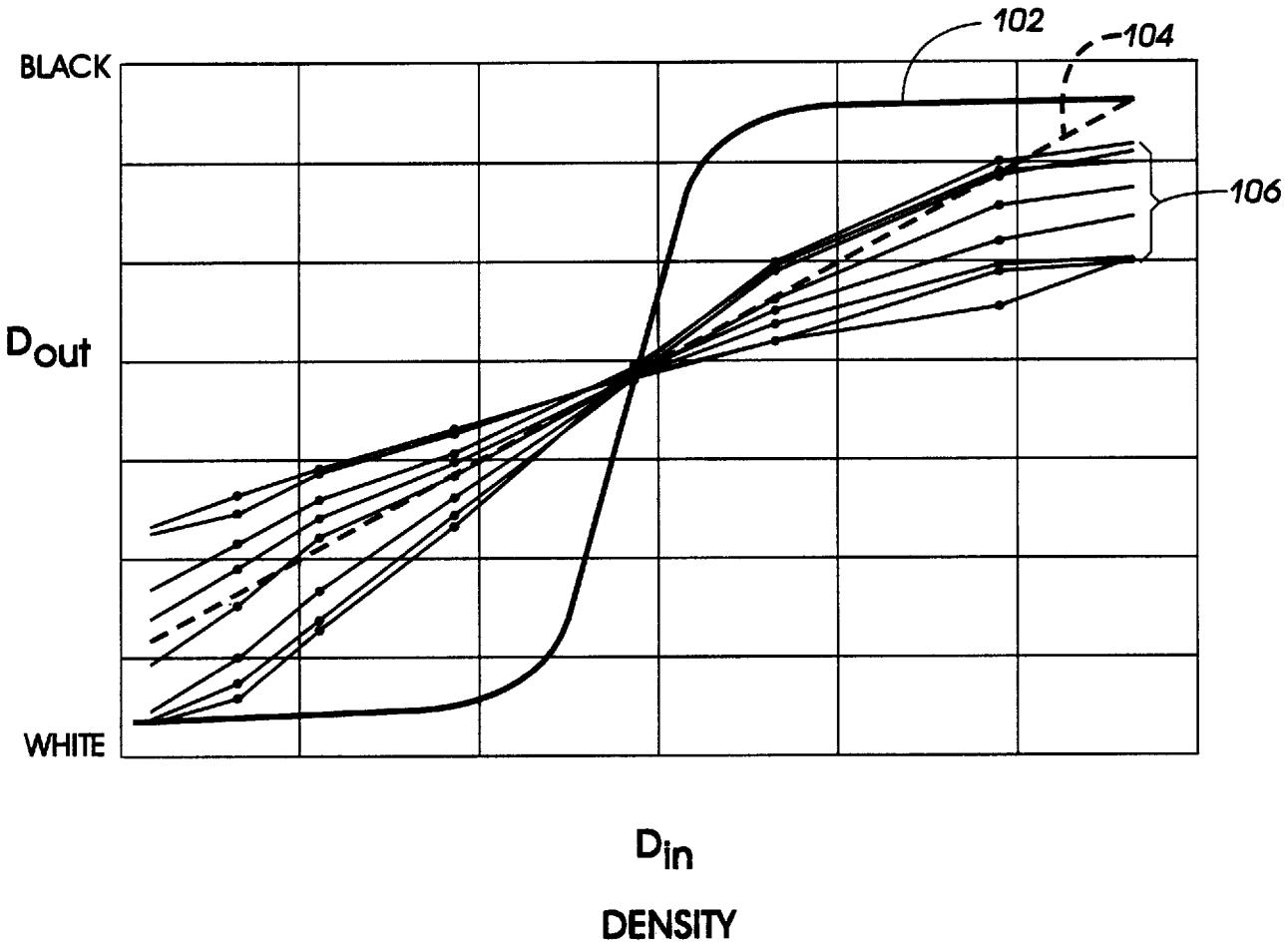
Figure 3:
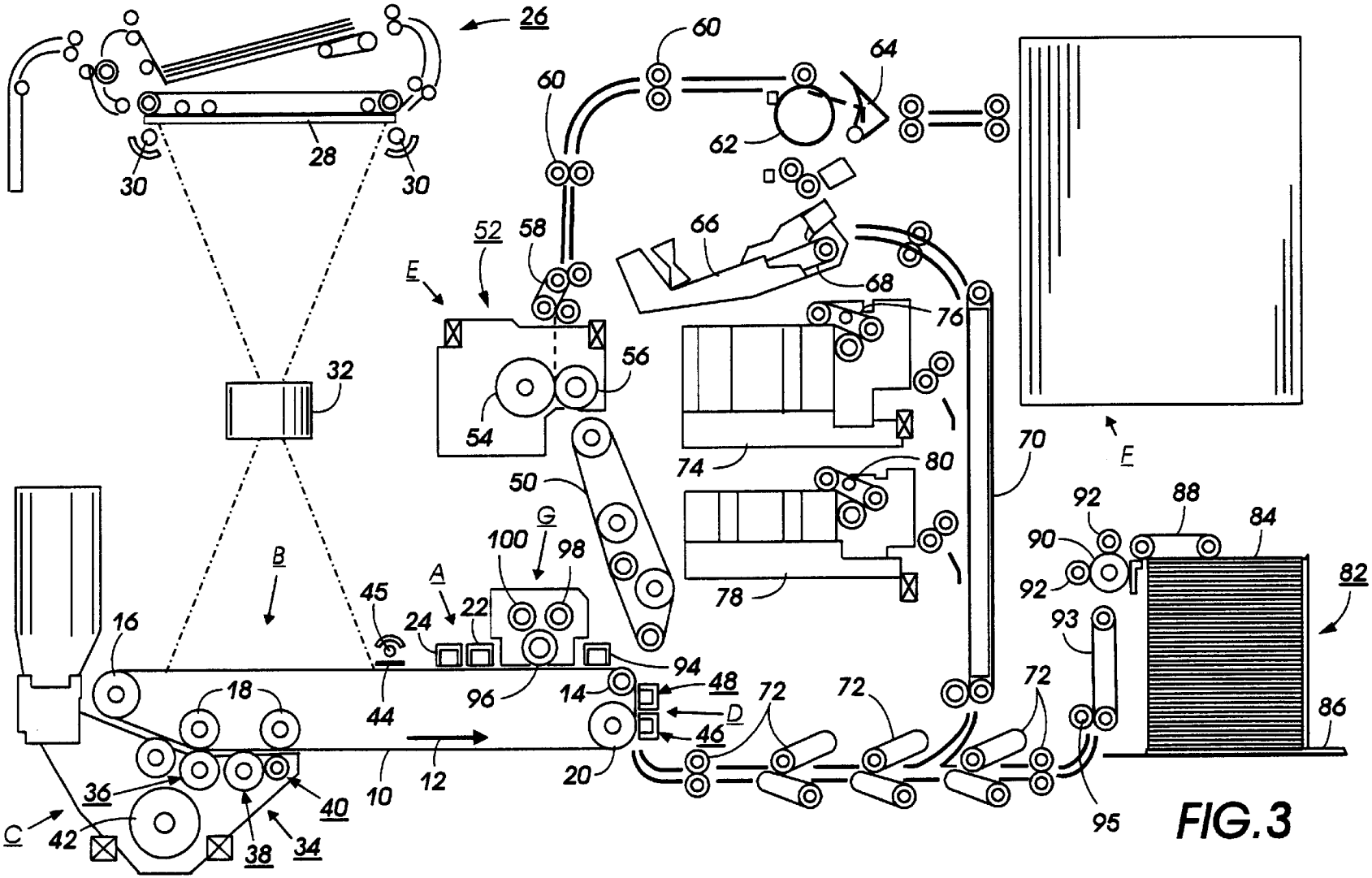

These and other aspects of the present invention will become apparent from the following description in conjunction with the accompanying drawings in which:

FIG. 1 is an exploded view of an exemplary image exposure subsystem, including a sequentially segmented light transmission system of the type used for producing a line screen pattern in the photomode copy contrast control system of the present invention;

FIG. 2 is a graphical representation of the image density characteristics for input and output images, showing the "ideal" density input image vs. output image density relationship, as well as various measured data points used to derive a formula for varying photomode output image contrast as provided by the present invention; and FIG. 3 is a schematic elevational view depicting an illustrative electrostatographic printing machine of the type which could advantageously utilize the photomode contrast control system of the present invention.

For a general understanding of the features of the present invention, reference is made to the drawings, wherein like reference numerals have been used throughout to identify identical or similar elements. Turning initially to FIG. 3 prior to discussing the invention in detail, a schematic depiction of an exemplary electrophotographic reproducing machine incorporating various machine components is furnished in order to provide a general background and understanding of the features of the present invention. It will be noted that, although the contrast control system of the present invention is particularly well adapted for use in an automatic electrophotographic reproducing machine as shown in FIG. 3, the concept of the present invention is equally well-suited for use in a wide variety of electrostatographic copying and printing machines, and it is further noted that the present invention is not necessarily limited in its application to the particular embodiment or embodiments shown and described herein. On the contrary, the following description is intended to cover all alternatives, modifications, and equivalents, as may be included within the spirit and scope of the invention as defined by the appended claims.

The exemplary electrophotographic printing machine of FIG. 3 employs a photoconductive belt 10, preferably comprising a photoconductive surface material coated on an electrical grounding layer, which, in turn, is coated on an anti-curl substrate. Belt 10 is entrained about stripping roller 14, tensioning roller 16, rollers 18, and drive roller 20, wherein stripping roller 14 and rollers 18 are mounted rotatably so as to rotate with belt 10, while tensioning roller 16 is resiliently urged against belt 10 to maintain the belt under a predetermined tension. Drive roller 20 is rotated by a motor (not shown) for advancing belt 10 in the direction of arrow 12 to transport successive portions of the photoconductive surface sequentially through the various processing stations disposed about the path of movement of the belt 10, as will be described generally hereinbelow Initially, a portion of photoconductive belt 10 passes through charging station (A), whereat a pair of corona generating devices, indicated generally by the reference numerals 22 and 24, charge photoconductive belt 10 to a relatively high, substantially uniform potential. This exemplary dual, or "split" charging system, is designed so that corona generating device 22 places substantially all of the required charge on photoconductive belt 10, while corona generating device 24 acts as a leveling device to provide a uniform charge across the surface of the belt. Corona generating device 24 also fills in any areas missed by corona generating device 22.

In a typical functional print mode, after belt 10 is charged to a substantially uniform charge potential, the belt is advanced to an imaging station (B) for selectively dissipating the charge on the photocondutive member in accordance with the image information to be recorded thereon. The imaging station generally includes a document handling unit, indicated generally by reference numeral 26, positioned in alignment with a transparent document platen 28. Imaging of the document is accomplished by a pair of flash lamps 30 mounted in an optics cavity for illuminating an input document (not shown) positioned on platen 28. Light rays are reflected from the input document and through lens 32, which focuses a light image of the original input document onto the charged portion of the photoconductive surface to selectively dissipate the charge thereon in image configuration. This process records an electrostatic latent image on photoconductive belt 10 corresponding to the informational areas contained within the original document.

In contrast to the typical functional mode printing described above, pictorial or photomode copying may involve the preliminary step of generating a line screen pattern on the photoreceptor surface. As such, the initially uniformly charged photoconductive member is passed through a line screening station prior to or simultaneous with recording of the electrostatic latent image on photoconductive belt. As shown in FIG. 2, an exemplary line screening station includes a light source 45 and an associated sequentially segmented line screen member 44, typically provided in the form of a sheet or film having a plurality of opaque lines thereon. The line screen member 44 is interposed into the optical light path of the light source 45 such that the light source 45 transmits light rays onto the photoconductor surface through the line screen member 44. The light passing through line screen member 44 is modulated so as to form a modulated light signal which irradiates the charged portions of photoconductive surface 10 in a cyclical line pattern forming a uniform pattern of charged and uncharged lines on the previously uniformly charged photoconductor. A similar arrangement is disclosed in U.S. Pat. No. 4,124,287 issued to Bean et al., incorporated by reference herein, wherein a system is provided for forming an imagewise non-uniform charge pattern, including a corona device for uniformly charging a charge-retentive surface, a transparent tube having a screen pattern marked on its surface, and a fluorescent tube for exposing the surface, subsequent to uniform charging, to a regular pattern of dark and light, as well an imaging station for subsequently exposing the surface to an imagewise pattern of light. By exposing the uniformly charged surface to a regular pattern of dark and light, a line screen pattern is established on the photoconductive surface which is useful with either simultaneous or subsequent exposure to a light image pattern for generating halftone images in the photomode imaging process.

After the latent image is recorded on the photoreceptor surface, whether in the functional or the pictorial mode, the photoconductive belt 10 is advanced to development station (C), where a developer housing, indicated generally by reference numeral 34, is provided for depositing developing material on the latent image bearing photoconductor. In the exemplary system of FIG. 3, the developer housing 34 is embodied as a magnetic brush development system, including a paddle wheel 42 for transporting and delivering developer material to developer rolls, indicated generally by the reference numerals 36. Photoconductive belt 10 is partially wrapped about rolls 36 to form an extended development zone thereabout, wherein developer material is brought into contact with the electrostatic latent image. The latent image attracts toner particles from the developer material to form a visible toner image on the photoconductive surface of belt 10. In this exemplary development system, roll 40 is provided as a cleanup roll and magnetic roll 44 is provided as a carrier granule removal device adapted to remove any carrier granules which may adhere to belt 10. Thereafter, belt 10 advances the toner powder image to a transfer station (D).

At the transfer station, a copy sheet (not shown) is moved into contact with the toner powder image on belt 10. A high capacity feeder, indicated generally by the reference numeral 82, is the primary source of copy sheets. Alternatively, copy sheets may be fed to the transfer station from a secondary tray 74 via sheet feeder 76 and transport 70. In addition, copy sheets may also be fed to the transfer station from an auxiliary tray 78 via sheet feeder 80 and transport 70. Secondary tray 74 and auxiliary tray 78 are supplemental sources of copy sheets. In the case of high capacity feeder 82, a tray 84, supported on an elevator 86 is driven by a bidirectional motor to move the tray up or down. In the up position, the copy sheets are advanced from the tray to the transfer station via a vacuum feed belt 88 which feeds the successive uppermost sheet from the stack to a take away roll 90 operating in conjunction with rolls 92 to guide the sheet onto transport 93. Transport 93 and roll 95 advance the sheet to rolls 72 which, in turn, move the sheet into a transfer zone adjacent the photoreceptor where the developed image on belt 10 contacts the advancing sheet of support material in a timed sequence for transfer of the image thereto.

At the transfer station, a corona generating device 46 charges the copy sheet to a proper potential so that the sheet is electrostatically secured or "tacked" to belt 10 and the toner image thereon is electrostatically attracted to the copy sheet. After transfer, the copy sheet moves in unison with photoconductive belt 10, in the direction of arrow 12 and a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to the fusing station (E).

The fusing station includes a fuser assembly, indicated generally by the reference numeral 52, which permanently affixes the transferred toner powder image to the copy sheet. Preferably, fuser assembly 52 includes a heated fuser roller 54 and a pressure roller 56, whereby the powder image on the copy sheet contacts heated fuser roller 54 with the pressure roller 56 abutting the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheet is fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. Subsequently, the copy sheet may be advanced, via forwarding roller pairs 60 to duplex turn roll 62 whereat a duplex solenoid gate 64 selectively guides the copy sheet either to a finishing station (F) or to duplex tray 66. At the finishing station, the copy sheets are collected in sets and the copy sheets of each set can be stapled or glued together. Alternatively, if gate 64 diverts the sheet into duplex tray 66, those sheets that have been printed on one side and on which an image is to be subsequently printed on the opposite side are fed, in seriatim, by means of a bottom feeder 68 to the transfer station, via conveyor 70 and rollers 72, for transfer of the toner powder image to the opposite side of the copy sheets. The duplex sheet is then fed through the same path as the simplex sheet to be advanced to the finishing station.

Invariably, after the copy sheet is separated from photoconductive belt 10, some residual toner remains attached thereto. As such, after the image transfer process, photoconductive belt 10 passes beneath yet another corona generating device 94 which charges the residual toner particles to the proper polarity for breaking any electrostatic bond that may exist between the toner particles and the belt. Residual particles are removed from the photoconductive surface at a cleaning station (G) which typically includes an electrically biased cleaner brush 96 in combination with a pair of waste and reclaim detoning rolls 98 and 100. The reclaim roll 98 is electrically biased negatively relative to the cleaner roll 96 so as to remove toner particles therefrom while the waste roll 100 is electrically biased to the same polarity as to the reclaim roll 98 so as to remove paper debris and wrong sign toner particles from the cleaner roll.

The various machine subsystems and functions of the above described electrostatographic printing machine are typically regulated by an electronic subsystem (ESS) which preferably includes a programmable microprocessor for managing all of the machine functions described hereinabove and further including a non-volatile memory (NVM) for permitting programming thereof in accordance with a predetermined set of parameters. Generally, the ESS controls all the processes described herein, including such steps and functions associated with imaging onto the photoreceptor, paper delivery, xerographic functions related to developing and transferring the developed image onto the paper, and various processing functions provided by the finishing station. The ESS also initiates a sequencing schedule which is highly efficient in monitoring the status of a series of successive print jobs which are to be printed and finished in a consecutive fashion. In addition, conventional sheet path sensors or switches, which may be utilized to keep track of the position of documents and the sheets in the machine will be coupled to the ESS for regulating the various positions of gates and switching mechanisms, depending upon the mode of operation selected. The ESS may also provide time delays, jam indications and fault actuation. Most importantly, with respect to the present invention, the ESS is coupled to the imaging lamps 30 and the sequentially segmented line screen lamp 45 for providing enable/disable command signals, as well as timing and intensity control signals thereto, as will be described in greater detail. The operation of all of the exemplary systems and subsystems described hereinabove may be accompanied by a conventional user interface control device having the capability to provide operator input and output information through a console or graphic user interface device.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Referring now to FIG. 1, there is shown an exemplary embodiment of the exposure station including a line screening system associated therewith capable of producing both functional mode and photomode copies. Mode selection is an operator function such that the operator, by activating a control switch, selects the mode of operation.

In the functional mode of operation, line screen lamp 45 remains inoperative such that the electrostatic latent image forming process involves the conventional process of projecting light rays reflected from an original input document onto a substantially uniformly charged portion of the photoreceptor belt for selectively dissipating the uniform charge thereon in accordance with the informational areas contained within the original input document. Conversely, selection of the pictorial mode causes the line screen lamp to become energized, such that light source or lamp 45 provides additional non-image illumination, with the light rays from lamp 45 passing through screen member 44, forming a line screen pattern of charged and uncharged lines or dots on the photoconductor 10. It will be understood that screen member 44 may be positioned either prior to or subsequent to the light image optical path. In the event that the screen is located after the formation of the light image, the screen light pattern will be projected into superimposed registration with the latent image of the original document recorded on photoconductive surface.

As a result of the line screening process, the latent image on photoconductor 10 becomes a composite made up of the light image transmitted through lens 32 superimposed on the line screen pattern produced on the photoreceptor surface. Thus, the latent image is transformed into a plurality of discrete charge bearing zones in the form oflines or dots which can then be developed to produce half tone copies of continuous tone images. Thus, in the areas where the line screen pattern and the latent image combine such that a greater amount of light impinges on the photoconductor, the charge pattern and fringe fields which are necessary for development of the image will be greatly reduced. Conversely, in the areas where the line screen pattern and the latent image combine such that no light impinges on the photoconductor, the charge pattern and fringe fields necessary for development of the image will, in large part, be retained, facilitating development on area of the photoconductor. Intermediate shades will be made up of lines or dots having various sizes to produce the effect of tone gradations. This technique yields enhanced tone variation and is well known in the art of electrostatographics, as well as the field of photomechanical imaging systems in general, for producing the effect of tone gradations by the variation of dot size.

Thus, in the pictorial copy mode, a sequentially segmented screen member modulates a pictorial input light image to create a halftone pictorial copy. A typical screen member 44 includes a plurality of substantially equally spaced opaque lines. Screen member 44 may be formed on a translucent layer or substrate which adheres to a transparent portion or substrate. The transparent portion may be preferably from a suitable flexible transparent plastic sheet such as Mylar. Screen member 44 may include a plurality of lines printed on a substantially transparent substrate by a suitable chemical etching technique, or by a photographic technique. The screen itself may be made from any number of opaque metallic materials suitable for chemical etching such as copper or aluminum. Hence, while a coarse screen having 50 to 60 lines per linear inch will be useful for some purposes, finer screens such as those having anywhere from 100 to 400 or more lines per inch will give a more nearly continuous tone appearance to the finished copy. Finer screen patterns generally result in a more natural or higher quality copy, since the screen pattern may be barely perceptible on the finished copy and a copy will have the appearance of a continuous tone photograph. The preferred embodiment of the present invention contemplates a line screen device which offers the electrostatic change on the photoreceptor with a line pattern of 105 lines per inch.

As previously noted, the photomode is enabled or disabled via a control switch which energizes light 45 for generating the line screen pattern on the photoconductor 10. In addition to this enable/disable function, the machine operator can also independently adjust photomode darkness and contrast, preferably via two sets of operator accessible controls which may be provided in the form of a movable lever, sets of depressable buttons or so-called "soft" buttons on a graphical user interface. Alternatively, the variable darkness and contrast adjustment controls may be restricted so as to be accessible by qualified personnel only, such as a service technician or key operator or the like.

In accordance with the present invention, image contrast is controlled by varying the intensity of light emitted from the two light sources, namely imaging light source 30 and line screen light source 45 generating the pictorial mode latent image. Moreover, it has been found by the present invention that image contrast can be varied while maintaining constant image darkness/lightness by controlling the ratio of light output between the imaging light source 30 and the line screen light source 45. Thus, it has been found that while the light intensity of either lamp 30 or 45 can be varied to modify photomode copy contrast, the overall darkness of the output copy may be held constant by maintaining the total light output of these two lamps 30 and 45 substantially constant. Contrast is, therefore, varied as a function of the ratio of light emitted from light sources 30 and 45. In the simplest embodiment of the present invention, the contrast control can be accomplished by separate controls, implemented via simple potentiometer or via more sophisticated software control, for varying the excitation voltage applied to each lamp 30 and 45. Alternatively, as illustrated in FIG. 2, this ratio may be programmed into non volatile memory (NVM) for controlling the excitation voltage applied to each lamp 30 and 45.

The process of the present invention may be described theoretically with reference to the graphical representation of density input and output, as shown in FIG. 2. The graph of FIG. 2 illustrates a series of tone reproduction curves, wherein input image density is plotted along the X-axis while output image density is plotted along the Y-axis. A typical functional mode tone reproduction curve is represented by the bold line identified by reference numeral 102 where it can be seen that image input and output densities are substantially binary: a low density input (light image area) is reproduced as a low density output; and a high density input (dark image area) is reproduced as a high density output. An ideal photomode tone reproduction curve is represented by dotted line 104 where it can be seen that the image output density varies linearly with image input density. Lines 106 represent a series of data points collected to determine a formula for defining the lamp voltage ratio effective to maintain image darkness substantially constant while allowing for contrast control. This formula is determined by simple linear extrapolation such that the voltage applied to the line screen lamp 45 can be defined in terms of the sum of a constant voltage value and some multiple of the voltage applied to the imaging lamps 30. For example:

$$V_{LS}=C-((V_{IL})(X)),$$

where $V_{LS}$=Line Screen Lamp Voltage; c and x are constants; and $V_{IL}$=Image Lamp Voltage This formula will maintain image darkness while adjusting contrast by causing rotation of the tone density curve about a fixed point as shown in FIG. 2. Ultimately, operator controls enable the imaging and line screen lamp voltages to be varied in accordance along this linear relationship.

In review, it is evident that the electrophotographic printing machine heretofore described operates in one of two modes, i.e. a pictorial mode or a functional mode. In the pictorial mode, a light signal is transmitted through a line screen member to modulate the electrostatic latent image of the original document. In operation, the intensity of the light transmitted through the line screen may be varied to vary the contrast of the image generated thereby. Thus, pictorial image contrast is readily adjustable by regulating the light intensity of the light transmitted through the line screen member and onto the photoconductive surface. Moreover, by varying the intensity of the light transmitted through the line screen as a function of the light intensity of the image exposure lamp, the contrast of the pictorial image can be varied while maintaining constant image darkness. In this manner, high quality pictorial copies may be produced.

It is, therefore, apparent that there has been provided in accordance with the present invention, an electrophotographic printing machine that operates with variable contrast in the pictorial mode. This printing machine fully satisfies the objects, aims, and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A system for controlling image contrast in an electrostatographic imaging system having a photoconductive member, comprising:

a first light emitting source for projecting a light image of an original document onto the photoconductive member to create an electrostatic latent image thereon;

a second light emitting source for generating a line screen pattern on the photoconductive member such that the electrostatic latent image is positioned in superimposed registration with the line screen pattern on the photoconductive member to produce a modulated electrostatic latent image thereon;

apparatus for varying intensity of the light emitted from said first light emitting source;

apparatus for varying intensity of the light emitted from said second light emitting source; and a control system for maintaining a total amount of the light emitted from said first light emitting source and said second light emitting source substantially constant while varying the intensity of the light emitted from either said first or second first light emitting source.

2. The system of claim 1, wherein said control system includes a system for generating a first variable voltage signal for varying the light emitted from said first light emitting source; and a second variable voltage signal for varying the light emitted from said second light emitting source.

3. The system of claim 2, wherein said system for generating said first and second variable voltage signals includes an apparatus for modifying said second voltage signal as a function of said first voltage signal.

4. The system of claim 3, wherein said apparatus for modifying said second voltage signal as a function of said first voltage signal operates in accordance with the following equation:

$$V_2 = C - ((V_1)(x)),$$

where $V_1$ represents said first voltage signal;

$V_2$ represents said second voltage signal; and

C and x are constant parameters associated with the electrostatographic imaging system.

5. The system of claim 4, wherein said system for generating said first and second variable voltage signals further includes a programmable memory device adapted to operate in accordance with said equation.

6. The system of claim 1, wherein said second light emitting source includes:

a light source; and a screen member interposed between said light source and the photoconductive member such that the light source transmits light rays onto the photoconductive member through the screen member.

7. The system of claim 6, wherein said screen member includes a plurality of substantially equally spaced lines.

8. A method for producing halftone images in an electrostatographic copying machine including a photoconductive imaging member, comprising the steps of:

projecting a light image of an original document onto the photoconductive imaging member to create an electrostatic latent image thereon;

generating a line screen pattern on the photoconductive imaging member such that the electrostatic latent image is positioned in superimposed registration with the line screen pattern on the photoconductive imaging member to produce a modulated electrostatic latent image thereon;

varying an amount of light energy used in the light image projecting step;

varying an amount of light energy used in the line screen pattern generating step;

maintaining substantially constant a total amount of light energy used in said light image projecting step and said line screen pattern generating step while varying the light energy used in either said light image projecting step and said line screen pattern generating step.

9. The method of claim 8, wherein said step of varying said amount of light energy used in the light image projecting step includes generating a first variable voltage signal for varying said corresponding light energy, and said step of varying said amount of light energy used in the line screen pattern generating step includes generating a second variable voltage signal for varying said amount of corresponding light energy.

10. The method of claim 9, wherein said maintaining step includes the step of modifying said second voltage signal as a function of said first voltage signal.

11. The method of claim 10, wherein said step for modifying said second voltage signal as a function of said first voltage signal operates in accordance with the following equation:

$$V_2 = C - ((V_1)(x)),$$

where $V_1$ represents a first voltage signal utilized in varying an amount of light energy used in the light image projecting step;

$V_2$ represents a second voltage signal utilized in varying an amount of light energy used in the line screen pattern generating step;and C and x are constant parameters associated with the electrostatographic copying machine.

12. An electrostatographic printing machine for reproducing an original document having continuous tone pictorial information, comprising a photoconductive member;

means for charging said photoconductive member to a substantially uniform potential;

means, including an image exposure lamp, for projecting a light image of an original document onto said photoconductive member to create an electrostatic latent image thereon;

means, including a sequentially segmented lamp, for generating a line screen pattern on said photoconductive member, wherein the electrostatic latent image is positioned in superimposed registration with the line screen pattern on said photoconductive member to produce a modulated electrostatic latent image thereon;

means for controlling image contrast on a reproduced image, comprising:

means for varying intensity of the light emitted from said projecting means;

means for varying intensity of the light emitted from said generating means; and control means for maintaining a total amount of the light emitted from said projecting means and said generating means substantially constant while varying light emitted from either said projecting means or said generating means.

13. The electrostatographic printing machine of claim 12, wherein said control means includes means for generating a first variable voltage signal for varying the light emitted from said projecting means; and a second variable voltage signal for varying the light emitted from said generating means.

14. The electrostatographic printing machine of claim 13, wherein said means for generating said first and second variable voltage signals includes means for modifying said second voltage signal as a function of said first voltage signal.

15. The electrostatographic printing machine of claim 14, wherein said means for modifying said second voltage signal as a function of said first voltage signal operates in accordance with the following equation:

$$V_2=C-((V_1)(x)),$$

where $V_1$ represents said first voltage signal;

$V_2$ represents said second voltage signal; and

C and x are constant parameters associated with the electrostatographic imaging system.

16. The electrostatographic printing machine of claim 15, wherein said means for generating said first and second variable voltage signals further includes programmable memory means adapted to operate in accordance with said equation.

17. The electrostatographic printing machine of claim 12, wherein said second light emitting means includes:

a light source; and a screen member interposed between said light source and the photoconductive member such that the light source transmits light rays onto the photoconductive member through the screen member.

18. The electrostatographic printing machine of claim 17, wherein said screen member includes a plurality of substantially equally spaced lines.

* * * * *